US008979520B2

(12) United States Patent
Subacchi

(10) Patent No.: US 8,979,520 B2
(45) Date of Patent: Mar. 17, 2015

(54) CONCRETE ROLLER HEAD

(71) Applicant: Hawkeye Concrete Products Co., Mediapolis, IA (US)

(72) Inventor: Claudio Subacchi, Mediapolis, IA (US)

(73) Assignee: Hawkeye Concrete Products Co., Mediapolis, IA (US)

( * ) Notice: Subject to any disclaimer, the term of this patent is extended or adjusted under 35 U.S.C. 154(b) by 67 days.

(21) Appl. No.: 13/868,271

(22) Filed: Apr. 23, 2013

(65) Prior Publication Data

US 2013/0302462 A1 Nov. 14, 2013

Related U.S. Application Data

(60) Provisional application No. 61/646,592, filed on May 14, 2012.

(51) Int. Cl.
*B28B 21/24* (2006.01)
*B28B 11/08* (2006.01)
(Continued)

(52) U.S. Cl.
CPC ..... *B28B 11/0845* (2013.01); *B28B 21/26* (2013.01); *B28B 21/96* (2013.01); *B28B 21/247* (2013.01); *B28B 21/24* (2013.01)
USPC ..... 425/262; 425/427; 264/312

(58) Field of Classification Search
CPC .. B28B 11/0845; B28B 21/24; B28B 21/247; B28B 21/26; B28B 21/96
USPC ..... 425/262, 427; 264/312
See application file for complete search history.

(56) References Cited

U.S. PATENT DOCUMENTS 3,276,091 A * 10/1966 Pausch ..... 425/262
3,733,163 A * 5/1973 Hermann ..... 425/262
(Continued)

FOREIGN PATENT DOCUMENTS

DE 10253209 5/2004
DE 10253209 A1 * 5/2004
(Continued)

OTHER PUBLICATIONS

Haas et al., DE10253209 (A1), Bibliographic data from Espacenet.com with Abstract in English, accessed Aug. 18, 2014.*
(Continued)

*Primary Examiner* — Joseph S Del Sole
*Assistant Examiner* — Lawrence D Hohenbrink, Jr.
(74) *Attorney, Agent, or Firm* — Jason R. Sytsma; Shuttleworth & Ingersoll, PLC

(57) ABSTRACT

The extruder head assembly comprises of a drive shaft connected to a troweling cylinder. A plurality of rollers are spaced around the drive shaft and above the troweling cylinder and intermittently contact an inside surface as the troweling cylinder is rotated and pulled upward. The rollers are either elliptically shaped or round positioned on an eccentric axis for intermittent contact against an inside surface of the concrete pipe. The rollers compact the concrete mixture to form the outer surface and the troweling cylinder follows the compaction by smoothing the surface. The troweling cylinder comprises a plurality of removable sections. Each section is composed of a plurality of removable and replaceable tile segments. When a tile segment breaks, the section containing the broken tile segment can be removed so that the broken tile segment can be replaced.

17 Claims, 7 Drawing Sheets

(51) Int. Cl.
*B28B 21/26* (2006.01)
*B28B 21/96* (2006.01)

(56) References Cited

U.S. PATENT DOCUMENTS

| | | | | | |
|---|---|---|---|---|---|
| 4,407,648 | A | * | 10/1983 | Fosse | 425/457 |
| 4,668,447 | A | * | 5/1987 | Paakkinen | 264/70 |
| 5,051,223 | A | | 9/1991 | Kern | |
| 5,080,571 | A | * | 1/1992 | Crawford | 425/262 |
| 6,017,208 | A | * | 1/2000 | Schultz | 425/262 |
| 7,125,239 | B2 | | 10/2006 | Grau et al. | |
| 2007/0035065 | A1 | * | 2/2007 | Grau et al. | 264/269 |

FOREIGN PATENT DOCUMENTS

| | | |
|---|---|---|
| RU | 1794029 | 2/1993 |
| SU | 903125 | 2/1982 |
| SU | 1202892 | 1/1986 |
| SU | 1671461 | 8/1991 |

OTHER PUBLICATIONS

International Search Report and Written Opinion of the International Searching Authority dated Oct. 8, 2013 for counterpart PCT Application No. PCT/US2013/037704.

* cited by examiner

CONCRETE ROLLER HEAD

This non-provisional application claims priority to U.S. Provisional Application No. 61/646,592 filed May 14, 2012, the entirety of which is incorporated by reference herein.

BACKGROUND

This invention relates generally to the field of concrete pipe manufacturing machinery, and more specifically to the packerhead system of manufacturing concrete pipe.

It is conventional practice in dry casting of concrete pipe products to dispose a mold on the base of a concrete pipe machine that is provided with a vertically movable crosshead having a vertically driven shaft on the lower end of which a packer head is attached. The packer head typically includes a troweling cylinder that is rotated in one direction by the driven shaft, and a plurality of distributing rollers that are frictionally driven by engagement with the concrete in a direction opposite to that of the driven shaft on the troweling cylinder. With the packer head moved to its lowermost position so the top is at or below the level of a lower pallet, cement or concrete is fed to the interior of the mold. Then, as the crosshead is raised causing the packer head to be raised, the friction driven rollers pack the cement or concrete against the inner surface of the mold and the troweling cylinder is counter-rotated to finish the inner surface thereby forming the pipe. When the packer head reaches an upper pallet, the pipe is completed. The packer head is then withdrawn from the finished pipe and the form thus provided a molded pipe is replaced by an empty form and the pipe molding process repeated.

SUMMARY

An extruder head assembly for a concrete pipe manufacturing machine is disclosed. The head assembly comprises of a drive shaft connected to a troweling cylinder. A plurality of rollers are spaced around the drive shaft and above the troweling cylinder and intermittently contact an inside surface as the troweling cylinder is rotated and pulled upward. The rollers are either elliptically shaped or round positioned on an eccentric axis for intermittent contact against an inside surface of the concrete pipe. The rollers compact the concrete mixture to form the outer surface and the troweling cylinder follows the compaction by smoothing the surface.

In another embodiment, the troweling cylinder comprises a plurality of removable sections. Each section is composed of a plurality of removable and replaceable tile segments. When a tile segment breaks, the section containing the broken tile segment can be removed so that the broken tile segment can be replaced.

BRIEF DESCRIPTION OF THE ILLUSTRATED EMBODIMENTS

DETAILED DESCRIPTION OF THE INVENTION

Figure 1:
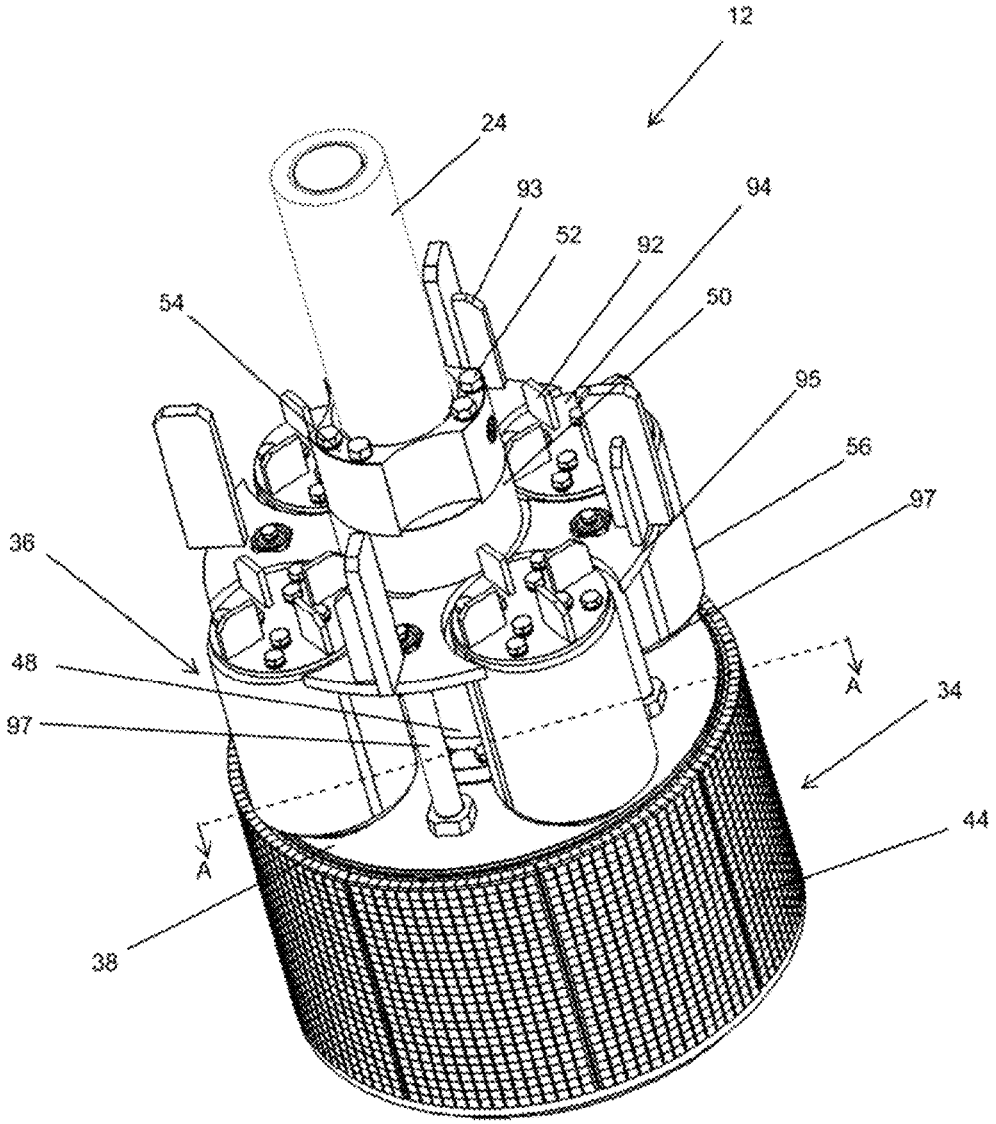
FIG. 1 is a perspective view an extruder head assembly embodying the present invention.

As best seen in FIG. 1, the lower portion of a concrete pipe manufacturing apparatus is provided with an extruder head assembly 12 embodying the present invention. Typically, a pipe manufacturing apparatus includes a turntable adapted to support a pallet and a cylindrical jacket or mold having a cylindrical reinforcing cage used in the formation of a tubular concrete pipe. An upper portion of the pipe manufacturing apparatus supports a downwardly directed drive shaft 24 to which the extruder head assembly 12 is mounted for simultaneous movement therewith vertically inside the mold. Drive shaft 24 is conventionally driven by a motor drive system mounted on the upper portion of the pipe manufacturing apparatus to provide rotational movement as well as vertical movement to the drive shaft 24 and the extruder head assembly 12. As is well known, a pipe making apparatus has a top table with a funneling mouth located above the upper end of the jacket for receiving a stream or flow of concrete as delivered from a feeding device such as a conveyor, which directs the concrete through the funneling mouth and into the jacket above the extruder head assembly 12.

Referring to FIG. 1, the extruder head assembly 12 has a troweling cylinder assembly 34 and a plurality of roller assemblies 36. Troweling cylinder assembly 34 includes a circular head plate 38. Connected centrally to the head plate 38 is an upstanding cylindrical hub 48 having a lower circular flange 50, which is secured by bolts 52 to a mating second circular flange 54 joined to the bottom end of drive shaft 24. The hub 48 and flanges 50, 54 are suitably dimensioned to allow the extruder head assembly 12 to adequately handle the rotational and vertical forces applied through the drive shaft 24.

Four upright fins or vanes 92 that extend upwardly from a horizontal base plate 94 fixed to the top of each roller 56 that forms a part of roller assemblies 36. Another pair of fins or vanes 93 extend upwardly from a horizontal base plate 95 that is fixed to hub 48 the base plate 95 extending between adjacent rollers 56 to prevent the concrete from falling downwardly around hub 48. Posts 97 that are fixed to circular head plate 38, support base plate 95. Vanes 92 and 93 function to centrifugally sling the wet concrete mixture being delivered into the jacket against the jacket.

Figure 2:
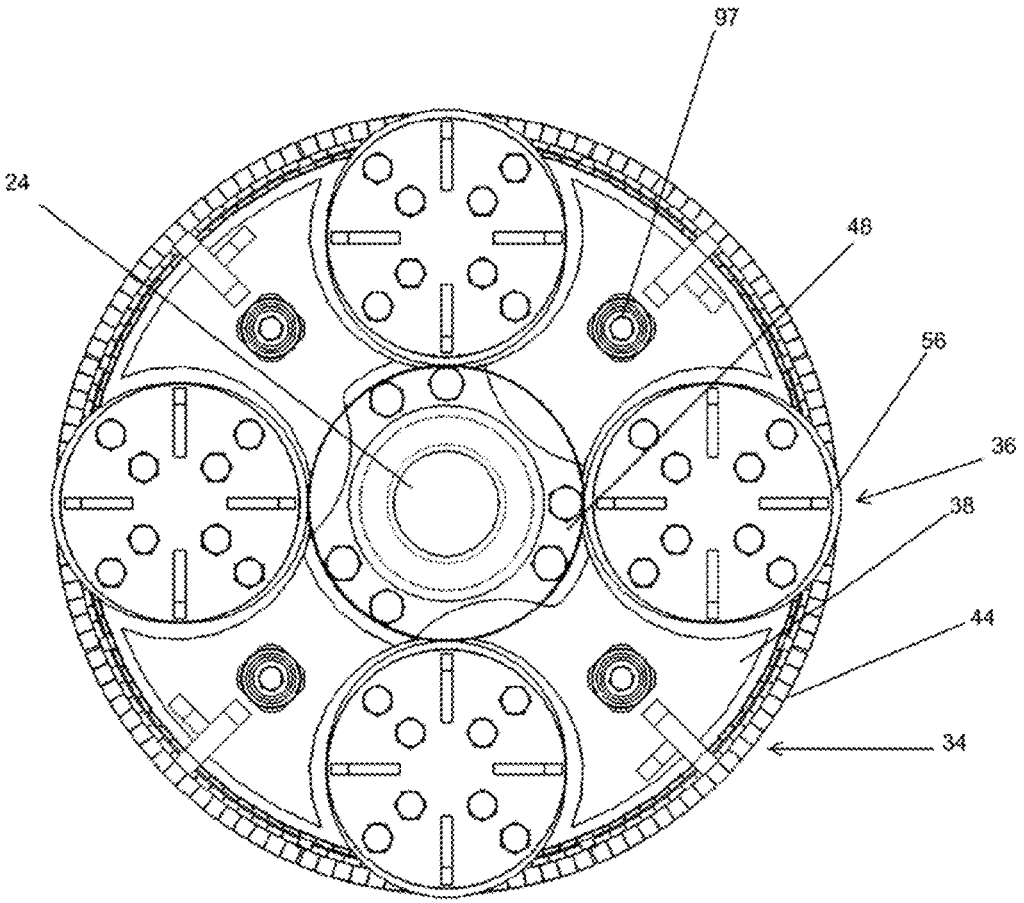
FIG. 2 is a cross sectional view of the extruder head assembly of FIG. 1 taken on the lines A-A.

Roller assemblies 36 include a plurality of elliptical or non-round rollers 56 for rotation relative to the head plate 38 of troweling cylinder assembly 34. As the extruder head assembly 12 is raised and rotated by drive shaft 24, rollers 56 are rotated by frictional contact with the wet concrete mixture in a direction counter to the direction of rotation of drive shaft 24 and troweling cylinder assembly 34 connected thereto. In the illustrated embodiment, a set of four rollers 56 are spaced about the periphery of head plate 38 to compact the concrete mixture delivered into the jacket. The outermost surface of rollers 56 is preferably in intermittent vertical alignment with an outer troweling surface 44 of the troweling cylinder, as seen in FIG. 2. One skilled in the art would recognize any number of rollers 56 could be used, but an even number of rollers 56 evenly spaced around the periphery balances the weight and equalizes the lateral forces on the drive shaft to minimize vibration.

FIG. 2 shows a cross-section of extruder head assembly 12 looking down on roller assemblies 36. As shown, each roller 56 is oblong or somewhat oval in configuration. The non-round rollers 56 rotate against the inside surface of the wet concrete mixture to compact the concrete mixture in the jacket. The rotation of non-round rollers 56 causes an oscillating impacting force against the inside surface of the concrete pipe to increase compaction of the concrete similar to a repeated paddling by rollers 56 against the wet concrete mixture. Compaction of the concrete mixture expels entrapped air and packs the aggregate particles together to increase the density of the concrete mixture and decrease its permeability. Compaction also greatly increases the ultimate strength and general durability of the concrete pipe that is produced.

Figure 7A:
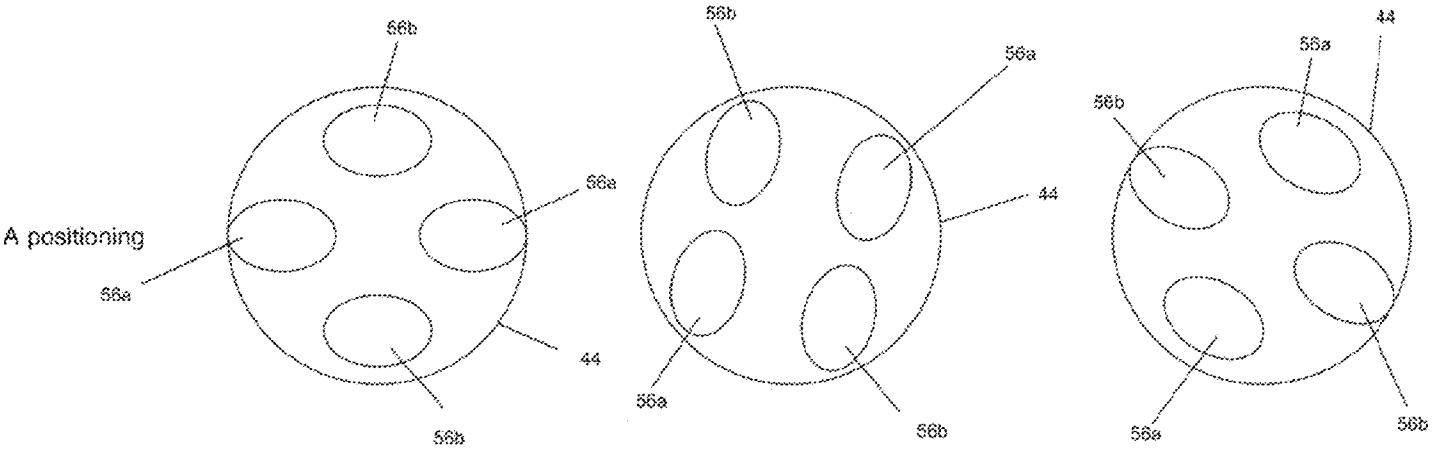
FIG. 7A is an illustration showing the orientation of the rollers with respect to each other.
Figure 7B:
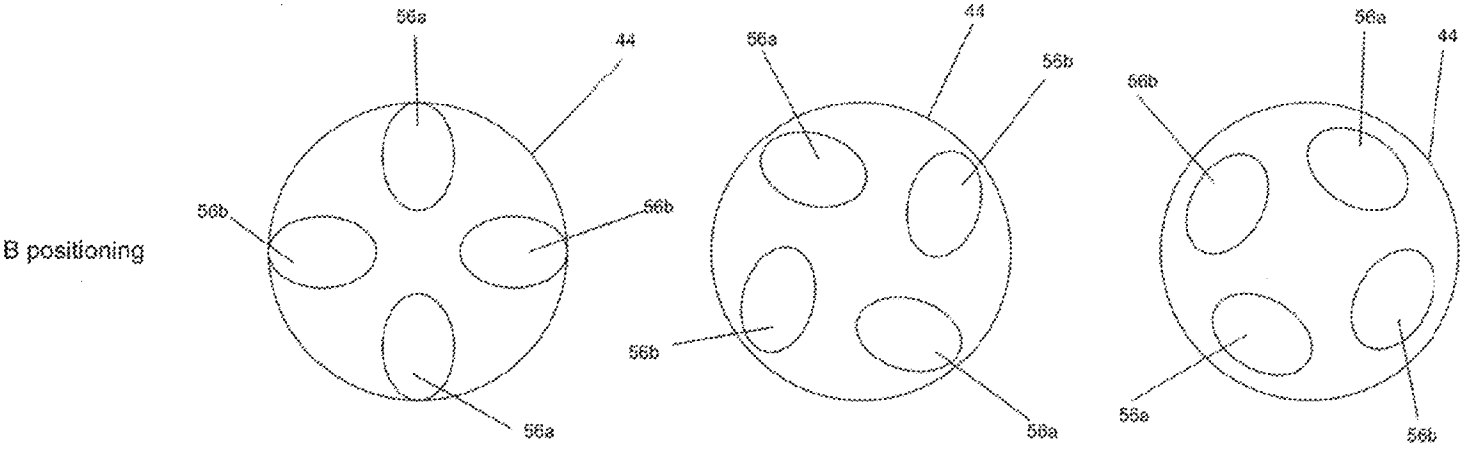
FIG. 7B is an illustration showing an alternative orientation of the rollers with respect to each other.

The timing of the oscillating impacting force by rollers 56 against the inside surface of the concrete pipe can be changed by adjusting the orientation of rollers 56 with respect to each other. FIGS. 7A and 7B show alternative orientations of rollers 56. FIG. 7A shows rollers 56 in three positions with rollers 56 oriented in the same direction throughout their rotation. At the first position, rollers 56*a* have their outermost edge in vertical alignment with outer troweling surface 44 of the troweling cylinder and rollers 56*b* are spaced apart from outer troweling surface 44. As rollers 56 rotate, shown in the second position, the outermost edges of rollers 56*a* rotate away from the outer troweling surface 44. In the third position, rollers 56*b* have their outermost edge in vertical alignment with the outer troweling surface 44 of troweling cylinder side all 42 and rollers 56*a* are spaced apart from outer troweling surface 44.

FIG. 7B shows rollers 56 in three positions with opposing rollers 56*a* and opposing rollers 56*b* ninety degrees out of phase with respect to each other throughout their rotation. At the first position, rollers 56*a* and 56*b* have their outermost edge in vertical alignment with the outer troweling surface 44 of troweling cylinder side all 42. As the rollers 56 rotate, shown in the second position, the outermost edges of rollers 56*a* and 56*b* rotate away from the outer troweling surface 44.

Figure 3:
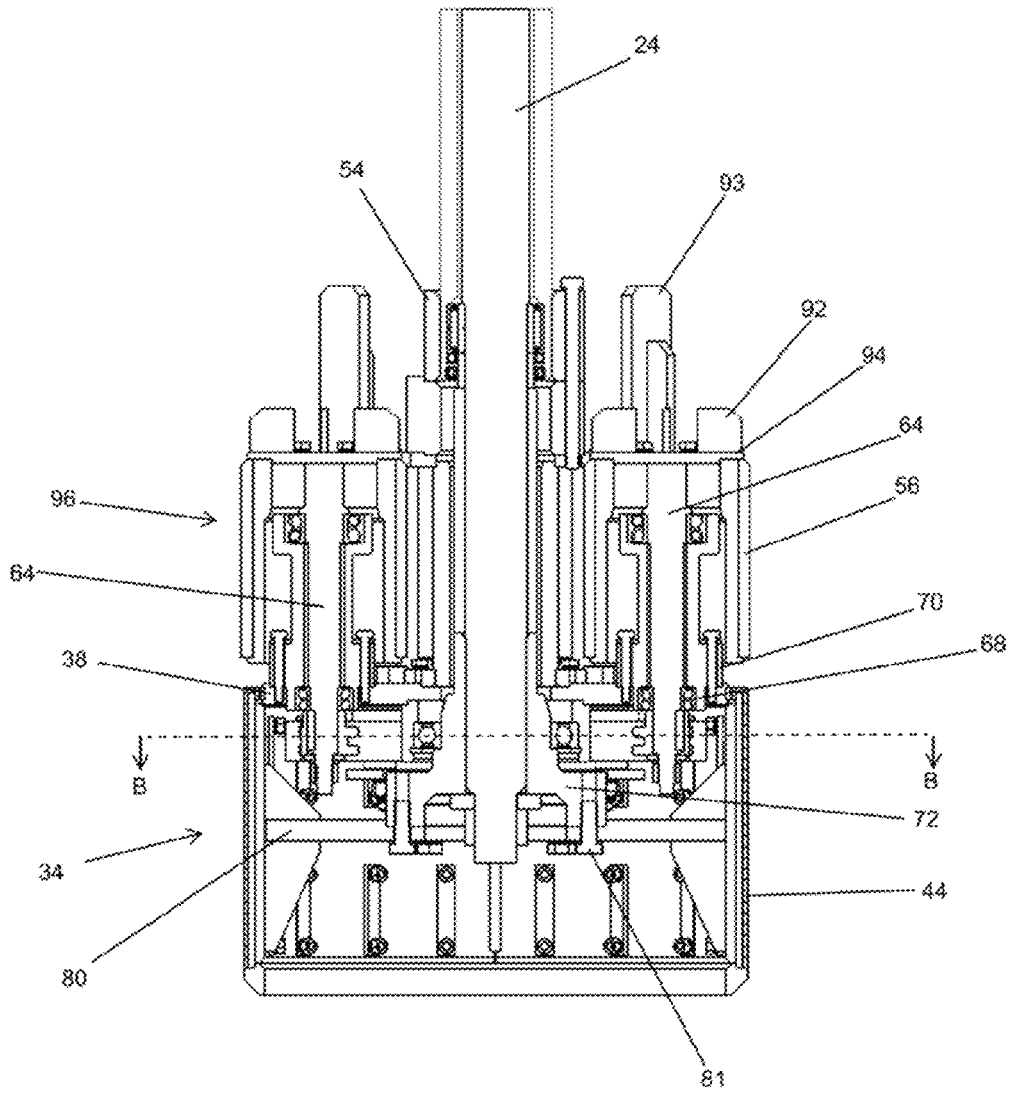
FIG. 3 is a vertical bi-sectional view of the extruder head assembly of FIG. 1.

FIG. 3 shows each roller 56 with a downwardly extending support shaft 64 that is rotatably mounted in a bore formed in a cylindrical bearing unit 68 fixed to and depending from the head plate 38. The bearing unit 68 has an annular collar 70 that is received in head plate 38. Each collar 70 has a height which will keep the bottom of roller 56 slightly spaced from the top of the head plate 38 so that there is adequate clearance for the rollers 56 to rotate. Also included in the bearing unit 68 is a set of conventional ball bearings, which surround the support shaft 64 and allow each roller 56 to freely rotate relative to the head plate 38.

A transmission arrangement interconnects each roller 56 in a manner that will synchronize the rotation and speed of the rollers 56 and equalize frictional forces should any of the friction driven rollers 56 become stuck or jammed because of concrete or other particles becoming lodged between the bottom of the roller 56 and the top of the head plate 38.

Figure 4:
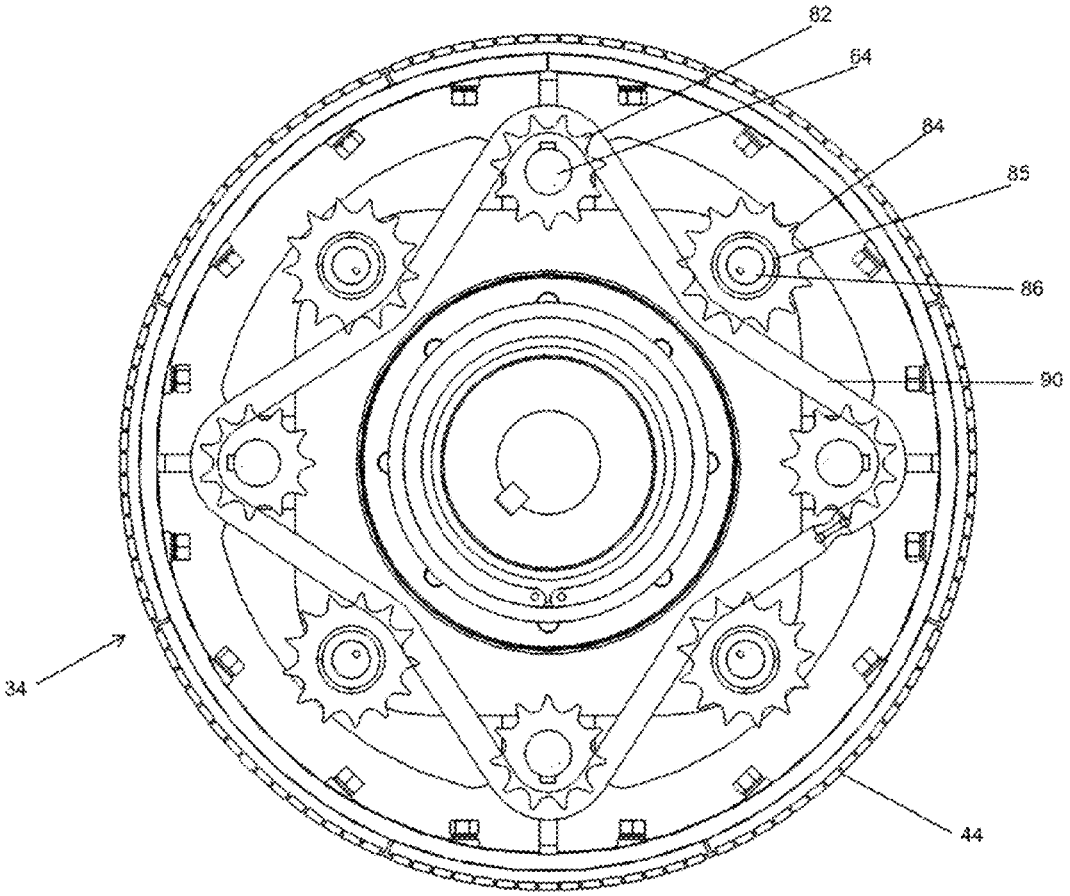
FIG. 4 is a cross sectional view of the extruder head assembly of FIG. 1 taken on the lines B-B in FIG. 3

FIG. 4 shows fourtooth-engaging drive sprockets 82, each keyed to the bottom end of each support shaft 64, such that rotation of the drive sprocket 82 will turn the support shaft 64 and the roller 56 relative to its bearing unit 68. Drive sprockets 82 are positioned on support shafts 64 such that they all lie in the same horizontal plane. Four spaced idler sprockets 84 having depending cylindrical sleeves 85 are rotatably supported on shafts 86 that are fixed to and extend downwardly from the bottom of head plate 38. Each idler sprocket 34 lies in the same horizontal plane as the drive sprockets 82. A linkage arrangement 90 interconnects each drive sprocket 82 along an outer peripheral portion and idler sprockets 84 along an inner peripheral portion and over a winding path. In the preferred embodiment, the linkage arrangement 90 takes the form of a chain, although it should be understood that a belt, gears or another suitable transmission arrangement could likewise be employed. Drive sprockets 82, idler sprockets 84, and linkage arrangement 90 define a synchronous friction drive for collectively driving the rollers 56 without sticking.

Figure 5:
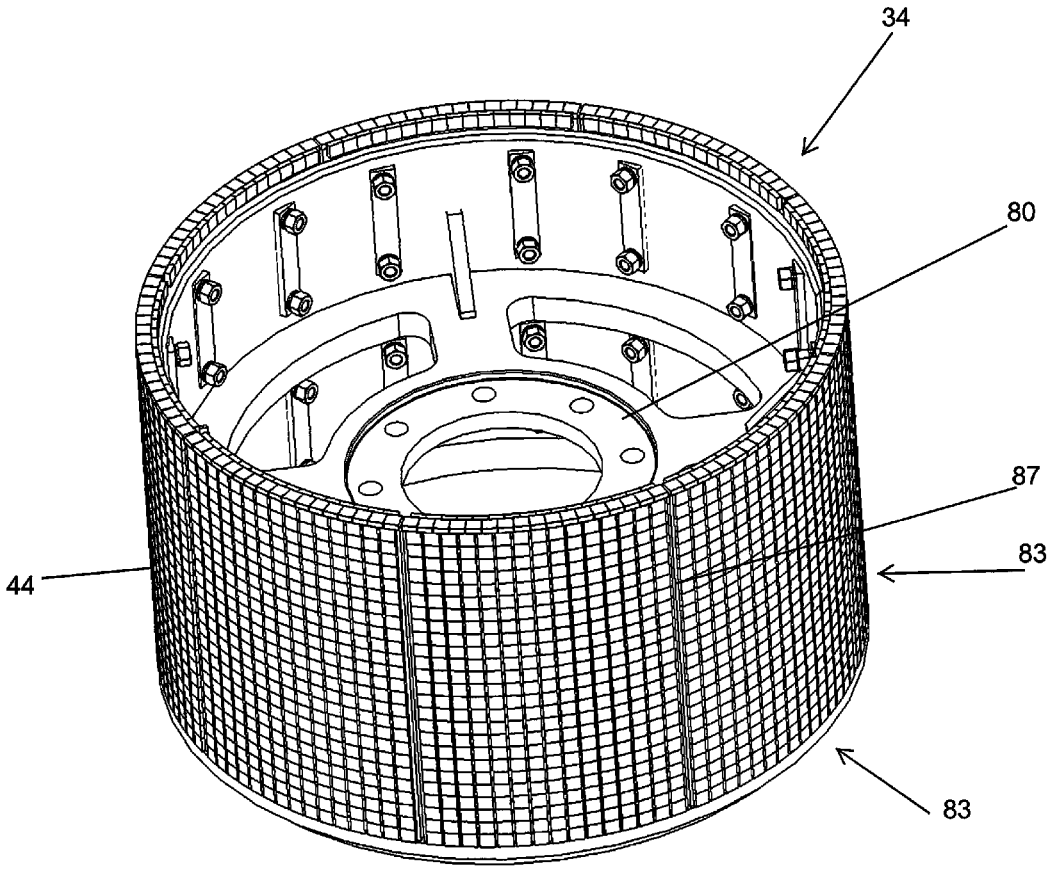
FIG. 5 is a perspective view looking from the top of the troweling cylinder assembly of FIG. 1.

FIG. 3 shows troweling cylinder assembly 34, which is mounted underneath circular plate 38 and connected to drive shaft 24 by a collar 72. FIG. 5 shows troweling cylinder assembly 34 removed from extruder head assembly 12. Collar 72 is connected to an inner circular flange 80 by several bolts 81, so that rotation of drive shaft 24 causes rotation of troweling cylinder assembly 34 in the same direction.

Figure 6:
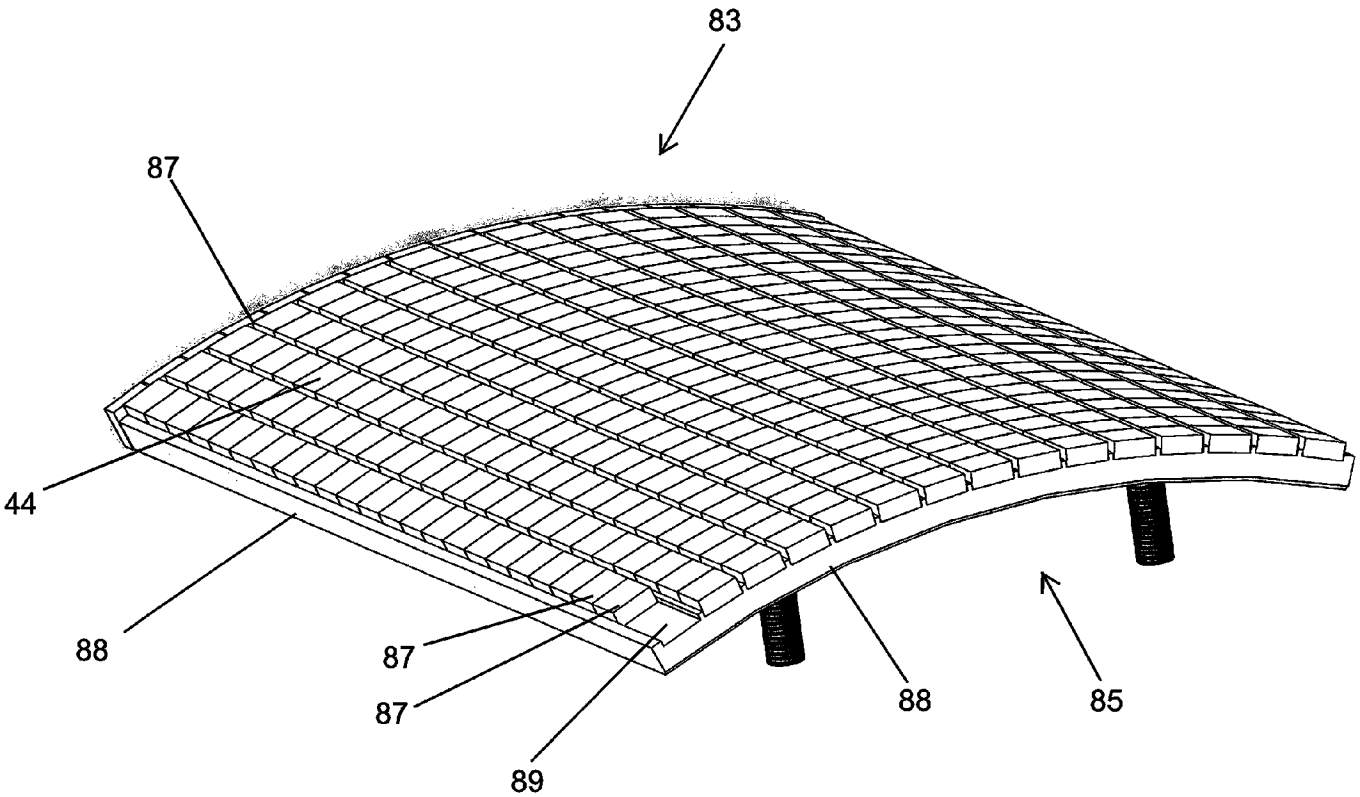
FIG. 6 is a perspective view of a section of the surface of the troweling cylinder assembly of FIG. 1.

The outer troweling surface 44 of the troweling cylinder assembly 34 has a segmented smooth outer surface comprised of a plurality of tiles 82 combined to segments of a steel plate 88 and positioned in grooves 88 in plate 89, as shown in FIG. 6. The troweling cylinder assembly 34 is composed of a plurality of individual sections 83, each of which is contoured, when assembled, to form a circular outer periphery.

Tiles 87 are made from an alumina, such as AL2O3, a tungsten carbide, or a similar ceramic or carbide material. Tiles 87 are less expensive that using a steel outer surface and they can be easily replaced once they begin to show signs of wear. Tiles 87 have may be brittle, so they are held in place with an elastic polymer, which provides elasticity for tiles 87 to prevent cracking. Grooves 89 in steel plate 88 provide a high strength structure that can absorb the shearing force on tiles 87 as trowel 34 is rotated against the concrete, which also prevents tiles 87 from cracking. If, however, tiles 87 crack, an entire outer section 83 can be removed and placed in a kiln to melt the polymer so the broken tiles 87 can be removed and replaced.

In use, extruder head assembly 12 is first positioned in the bottom of the jacket adjacent to the pallet. Concrete 30 is then moved by a conveyor into the funneling mouth on the top table and dropped onto extruder head assembly 12. Drive shaft 24 is then operated to rotate head plate 38 and troweling cylinder assembly 34 in one direction. As troweling cylinder assembly 34 rotates, the friction driven rollers 56 are rotated in an opposite direction by engagement with the concrete to form the concrete pipe as the extruder head assembly 12 moves up the mold. Concrete that is deposited on top of extruder head assembly 12 is slung by vanes 92 and 93 to the outside walls of the jacket. Thereafter, the concrete is acted upon by rollers 56 in an oscillatory motion to compact the concrete. As the extruder head assembly 12 is further rotated and lifted, the concrete is engaged by the smooth outer surface 44 formed from all of the individually spaced tiles 87 of the troweling cylinder assembly to provide a smooth finish to the inside surface of the finished concrete pipe.

In an alternative embodiment, roller assemblies 36 include a plurality of round rollers eccentric from an axis defined by downwardly extending support shaft 64. In that regard, round rollers spinning about eccentric axes have a similar affect as use of non-round rollers. The rotation causes an oscillating impacting force against the inside surface of the concrete pipe to increase compaction of the concrete similar to a repeated paddling by the rollers against the wet concrete mixture.

Reference has been made throughout this disclosure to "one embodiment," "an embodiment," or "embodiments" meaning that a particular described feature, structure, or characteristic is included in at least one embodiment of the present invention. Thus, usage of such phrases may refer to more than just one embodiment. Furthermore, the described features, structures, or characteristics may be combined in any suitable manner in one or more embodiments.

While the present invention has been particularly shown and described with reference to exemplary embodiments thereof, it should be understood by those of ordinary skill in the art that various changes, substitutions and alterations could be made herein without departing from the spirit and scope of the invention as embodied by the appended claims and their equivalents.

What is claimed is:

1. An extruder head assembly for a concrete pipe manufacturing machine used to manufacture a concrete pipe, comprising:

a drive shaft;

a plurality of rollers spaced around the drive shaft and each intermittently contacting an inside surface of the concrete pipe; and a troweling cylinder positioned beneath the plurality of rollers and combined to the drive shaft for synchronized rotation with the drive shaft.

2. The extruder head assembly of claim 1, and further comprising a transmission arrangement coupling each of the plurality of rollers together to create a synchronous friction drive for driving each of the rollers at the same speed and equalizing the frictional forces applied to the plurality of rollers.

3. The extruder head assembly of claim 2, wherein the transmission arrangement is non-motorized.

4. The extruder head assembly of claim 3, wherein the transmission arrangement includes a set of drive sprockets being fixed for rotation on one of the rollers; a set of idler sprockets, each idler sprocket lying in a same horizontal plane as the drive sprockets; and a linkage to link the drive sprockets and the idler sprockets together.

5. The extruder head assembly of claim 4, wherein the linkage is wound about an outer peripheral of the drive sprockets and an inner peripheral of the idler sprockets.

6. The extruder head assembly of claim 1, wherein the plurality of rollers is an even number of rollers spaced evenly around a periphery of the drive shaft to create a plurality of opposite roller pairs, wherein rotation of the opposite roller pairs cancels a lateral force from each roller in the opposite roller pairs to minimize vibration of the drive shaft.

7. The extruder head assembly of claim 6, wherein each roller of the even number of rollers rotates around a vertical axis, wherein the vertical axis of each roller remains in a plane with the opposite roller.

8. The extruder head assembly of claim 7, wherein the intermittent contact by each roller with the inside surface of the concrete pipe is an oscillating contact with the inside surface of the concrete pipe.

9. The extruder head assembly of claim 8, wherein the opposite roller pairs oscillate and contact the inside surface of the concrete pipe in phase with respect to each other.

10. The extruder head assembly of claim 9, wherein the opposite roller pairs oscillate and contact the inside surface of the concrete pipe ninety degrees out of phase with respect to adjacent opposite roller pairs.

11. The extruder head assembly of claim 10, wherein the plurality of rollers rotate counter to the rotation of the drive shaft.

12. The extruder head assembly of claim 11, and further comprising four rollers spaced around the drive shaft.

13. The extruder head assembly of claim 1, wherein the plurality of rollers each has elliptical cross section.

14. The extruder head assembly of claim 1, wherein each roller rotates around an eccentric axis.

15. An extruder head assembly for a concrete pipe manufacturing machine used to manufacture a concrete pipe, comprising:

a drive shaft;

a flange connected to the drive shaft;

a troweling cylinder combined to the flange for rotation with the drive shaft;

a plurality of removable contoured sections combined to the troweling cylinder;

a plurality of grooves on each contoured section, wherein the grooves have a sidewall on each side of the groove; and a plurality of tile segments positioned in the grooves adapted to smooth an inside surface of the concrete pipe, wherein the sidewalls of the grooves absorb a shearing force on the tiles as the troweling cylinder is rotated against the concrete pipe.

16. The extruder head assembly of claim 15, wherein the plurality of tile segments are attached to an outer periphery of the troweling cylinder with an elastic polymer so that a broken tile segment can be removed and replaced with another tile segment.

17. The extruder head assembly of claim 15, wherein the tile segments are made from one material chosen from an alumina, ceramic, and carbide.

* * * * *